US011532407B2

(12) United States Patent
Chen et al.

(10) Patent No.: US 11,532,407 B2
(45) Date of Patent: Dec. 20, 2022

(54) ALUMINUM CONDUCTOR ALLOYS HAVING IMPROVED CREEPING RESISTANCE

(71) Applicant: UNIVERSITE DU QUEBEC A CHICOUTIMI, Saguenay (CA)

(72) Inventors: Xiao-Grant Chen, Saguenay (CA); Lei Pan, Saguenay (CA); Kun Liu, Saguenay (CA); Alexandre Maltais, Chicoutimi (CA); Bruno Bourassa, Jonquière (CA)

(73) Assignee: UNIVERSITE DU QUEBEC A CHICOUTIMI, Chicoutimi (CA)

( * ) Notice: Subject to any disclaimer, the term of this patent is extended or adjusted under 35 U.S.C. 154(b) by 808 days.

(21) Appl. No.: 16/319,100

(22) PCT Filed: Jul. 19, 2017

(86) PCT No.: PCT/CA2017/050868
§ 371 (c)(1),
(2) Date: Jan. 18, 2019

(87) PCT Pub. No.: WO2018/014128
PCT Pub. Date: Jan. 25, 2018

(65) Prior Publication Data

US 2021/0335516 A1 Oct. 28, 2021

Related U.S. Application Data

(60) Provisional application No. 62/365,020, filed on Jul. 21, 2016.

(51) Int. Cl.
*C22C 21/00* (2006.01)
*H01B 1/02* (2006.01)

(52) U.S. Cl.
CPC ..... *H01B 1/023* (2013.01); *C22C 21/00* (2013.01)

(58) Field of Classification Search
CPC .. H01R 43/0207; H01R 43/048; H01R 4/183; H01R 4/188; H01R 4/62; H02G 15/076;
(Continued)

(56) References Cited

U.S. PATENT DOCUMENTS 1,815,479 A * 7/1931 Morell ..... C22C 18/02 420/521
3,668,019 A 6/1972 Hunsicker
(Continued)

FOREIGN PATENT DOCUMENTS

CN 102912193 A 2/2013
CN 103276257 A 9/2013
(Continued)

OTHER PUBLICATIONS

Dec. 17, 2019—(MA) Preliminary Search Report—App 44561.
(Continued)

*Primary Examiner* — Krystal Robinson
(74) *Attorney, Agent, or Firm* — Banner & Witcoff, Ltd.

(57) ABSTRACT

The present disclosure concerns aluminum conductor alloys having increased creep resistance, aluminum products comprising same and process using same. In some embodiments, the aluminum conductor alloy comprises, in weight percent: up to about 0.10 Si; up to about 0.5 Fe; up to about 0.30 Cu; between about 0.02 and about 0.1 Mg; up to about 0.04 B; and the balance being aluminum and unavoidable impurities.

18 Claims, 11 Drawing Sheets

(58) Field of Classification Search
CPC ..... H02G 15/14; H02G 9/12; C08K 5/5313; H01B 1/02; H01B 1/023; C22C 21/00
USPC ..... 174/126.1
See application file for complete search history.

(56) References Cited

U.S. PATENT DOCUMENTS

| | | | | |
|---|---|---|---|---|
| 4,182,640 | A * | 1/1980 | Yokota | C22C 21/12 148/438 |
| 9,263,168 | B2 * | 2/2016 | Sekiya | C22C 21/14 |
| 9,870,841 | B2 * | 1/2018 | Yoshida | C22F 1/04 |
| 9,899,119 | B2 * | 2/2018 | Yoshida | H01R 4/62 |
| 9,947,917 | B2 * | 4/2018 | Seki | H01B 5/02 |
| 2002/0066503 | A1 * | 6/2002 | Matsui | C22C 9/00 148/432 |
| 2002/0162683 | A1 * | 11/2002 | Fujiwara | H01R 4/62 174/74 R |
| 2008/0196923 | A1 * | 8/2008 | Su | C22C 21/00 174/110 R |
| 2012/0234427 | A1 * | 9/2012 | Verboom | C22C 21/04 138/143 |
| 2012/0234597 | A1 * | 9/2012 | Madden | H02G 15/076 174/74 R |
| 2013/0126055 | A1 | 5/2013 | Sekiya et al. | |
| 2013/0319585 | A1 * | 12/2013 | Parson | C22C 21/02 148/690 |
| 2014/0020796 | A1 | 1/2014 | Sekiya et al. | |
| 2014/0311769 | A1 * | 10/2014 | In | C22F 1/08 428/615 |
| 2015/0213913 | A1 * | 7/2015 | Yoshida | C22C 21/04 174/74 R |
| 2015/0235729 | A1 * | 8/2015 | Yoshida | C22C 21/00 174/74 R |
| 2018/0171439 | A1 * | 6/2018 | Kobayashi | H01B 7/00 |

FOREIGN PATENT DOCUMENTS

| | | | |
|---|---|---|---|
| CN | 103667810 | A | 3/2014 |
| CN | 104294090 | A | 1/2015 |
| CN | 104294093 | A | 1/2015 |
| CN | 105316535 | A | 2/2016 |
| CN | 106893899 | A * | 6/2017 |

OTHER PUBLICATIONS

Jan. 10, 2020—(CN) Office Action—App 201780045099.9.
Feb. 3, 2020—(EP) Supplemental Search Report—App 17830151.1.
Jan. 17, 2006, B. Raeisinia, W.J. Poole, D.J. Lloyd, Mater. "Examination of precipitation in the aluminum alloy AA6111 using electrical resistivity measurements" Sci. Eng. A 420, p. 245-249.
Feb. 9, 2013, C.J. Shi, W.M. Mao, X.G. Chen, "Evolution of activation energy during hot deformation of AA7150 aluminum alloy" Mater. Sci. Eng. A 571, p. 83-91.
May 22, 2003, E.A. Marquis, D.N. Seidman, D.C. Dunand, "Effect of Mg addition on the creep and yield behavior of an Al—Sc alloy" Acta Mater. 5, p. 4751-4760.
Dec. 19, 2000, F.J. Humphreys, J. "Review Grain and subgrain characterisation by electron backscatter diffraction" Mater. Sci. 36, p. 3833-3854.
Sep. 2016, L. Pan, K. Liu, F. Breton, X.-G. Chen, Abstract, "Effects of alloying elements on microstructure and creep properties of 8xxx aluminum conductor alloys".
2011, "Standard Specification for 8000 Series Aluminum Alloy Wire for Electrical Purposes-Annealed and Intermediate Tempers" ASTM International B800-05.
Jul. 19, 2013, X.W. Wei, X.T. Zu, W.L. Zhou, "Compressive creep behaviour of Mg—Li—Al alloy" Mater. Sci.Tech. 22, p. 730-733.
Oct. 12, 2017—International Search Report and Written Opinion of PCT/CA2017/050868.

* cited by examiner

ALUMINUM CONDUCTOR ALLOYS HAVING IMPROVED CREEPING RESISTANCE

CROSS-REFERENCE TO RELATED APPLICATIONS AND DOCUMENTS

This is application is a U.S. National Phase filing of International Application No. PCT/CA2017/050868, filed on Jul. 19, 2017, which claims priority to U.S. provisional patent application No. 62/365,020 filed on Jul. 21, 2016, which prior applications are incorporated herewith by reference in their entireties.

TECHNOLOGICAL FIELD

The present disclosure concerns aluminum alloys that can be used as an electrical conductor material.

BACKGROUND

As the economy has developed in the past few decades, the demand for the electrical conductor materials has been significantly increasing. The 8xxx aluminum conductor alloys offer significant advantages such as low density, high conductivity to weight ratio and low cost over copper conductors. They progressively replace the copper conductor alloy in overhead transmission and distribution. For a wide application of aluminum conductors, it is necessary for them to satisfy the overall requirement of properties in electrical industry, notably the electrical conductivity, tensile strength and creep resistance. Consequently, considerable efforts have been devoted to develop the aluminum conductor alloys with high comprehensive properties.

Alloying of commercially pure aluminum alloy may create solid solution or individual phases that greatly improve tensile strength due to solid solution strengthening and precipitation strengthening. However, the electrical conductivity may drop because of the enhanced scattering of free electrons at solute atoms and precipitates. For electrical applications, it is a challenge to find a favourable combination of high electrical conductivity with enhanced mechanical properties in the alloy design and development.

In addition, creep property is one of the most important properties required in aluminum conductor alloys. Due to the Joule effect, temperature increase in the aluminum conductor and creep resistance is needed to avoid long term deformations.

It would be desirable to obtain an aluminum conductor alloy having improved creep resistance at relatively low temperatures without substantially decreasing its electrical conductivity. Alternatively or in combination, it would also be desirable to obtain an aluminum conductor alloy having improved cast properties.

BRIEF SUMMARY

The present disclosure concerns aluminum conductor alloys which, once cast, have improved creep resistance when compare to corresponding aluminum conductor alloys having less than 0.1 Mg (in weight percent).

In a first aspect, the present disclosure concerns aluminum conductor alloy having increased creep resistance. The aluminum conductor alloy comprises, in weight percent:

up to about 0.10 Si;
up to about 0.5 Fe;
up to about 0.30 Cu;

between about 0.02 and about 0.1 Mg;
up to about 0.04 B;
and the balance being aluminum and unavoidable impurities.

In an embodiment, the aluminum conductor alloy comprises up to about 0.05 Si. In another embodiment, the aluminum conductor alloy comprises between about 0.3 and about 0.5 Fe. In still another embodiment, the aluminum conductor alloy comprises between about 0.15 and about 0.30 Cu, for example, up to about 0.18 Cu. In still yet another embodiment, the aluminum conductor alloy comprises up to about 0.052 Mg or up to about 0.025 Mg. In yet another embodiment, the aluminum alloy comprises between about 0.001 and about 0.04 B. In a further, embodiment, the aluminum alloy has a secondary creep rate of $1\times10^{-8}$ $s^{-1}$ or less when measured at 100° C. under a 69 MPa load.

In a second aspect, the present disclosure concerns a rod comprising the aluminum conductor alloy described herein.

In a third aspect, the present disclosure concerns an aluminum cast product comprising the aluminum conductor alloy described herein. The aluminum cast product can be, for example, a wire.

In a fourth aspect, the present disclosure concerns a process for improving the creep resistance of an aluminum product comprising a modified aluminum conductor alloy when compared to a corresponding aluminum product comprising a first aluminum conductor alloy. Broadly, the process comprises combining Mg with the first aluminum conductor alloy to provide the modified aluminum conductor alloy. The first aluminum conductor alloy comprises, in weight percent:

up to about 0.10 Si;
up to about 0.5 Fe;
up to about 0.30 Cu;
up to about 0.04 B;
and the balance being aluminum and unavoidable impurities.

In the process, the modified aluminum alloy comprises between about 0.02 and about 0.1 Mg. In an embodiment, the modified aluminum conductor alloy comprises up to about 0.05 Si. In another embodiment, the modified conductor aluminum alloy comprises between about 0.3 and about 0.5 Fe. In still another embodiment, the modified conductor aluminum alloy comprises between about 0.15 and about 0.30 Cu, such as, for example, up to about 0.18 Cu. In still another embodiment, the modified conductor aluminum alloy comprises up to about 0.052 Mg. In still another embodiment, the modified conductor aluminum alloy comprises up to about 0.025 Mg. In yet another embodiment, the modified conductor aluminum alloy comprises between about 0.001 and about 0.04 B. In still yet another embodiment, the modified conductor aluminum alloy has a secondary creep rate of $1\times10^{-8}$ $s^{-1}$ or less when measured at 100° C. under a 69 MPa load.

In a fifth aspect, the present disclosure provides an aluminum conductor alloy (also referred to as a modified aluminum alloy) obtainable or obtained by the process described herein. In an embodiment, the aluminum conductor alloy can be in the form of a rod.

In a sixth aspect, the present disclosure provides a process for making an aluminum product having improved creep resistance, the process comprising working the aluminum conductor alloy described herein, obtainable or obtained by the process described herein or the rod described herein in the aluminum product.

In a seventh aspect, the present disclosure provides an aluminum product obtainable or obtained by the process described herein. In an embodiment, the aluminum product can be a wire.

In the context of the present disclosure, the term "about" means that the recited numerical value is part of a range that varies within standard experimental error.

BRIEF DESCRIPTION OF THE DRAWINGS

Having thus generally described the nature of the invention, reference will now be made to the accompanying drawings, showing by way of illustration, a preferred embodiment thereof, and in which.

DETAILED DESCRIPTION

Figure 1A:
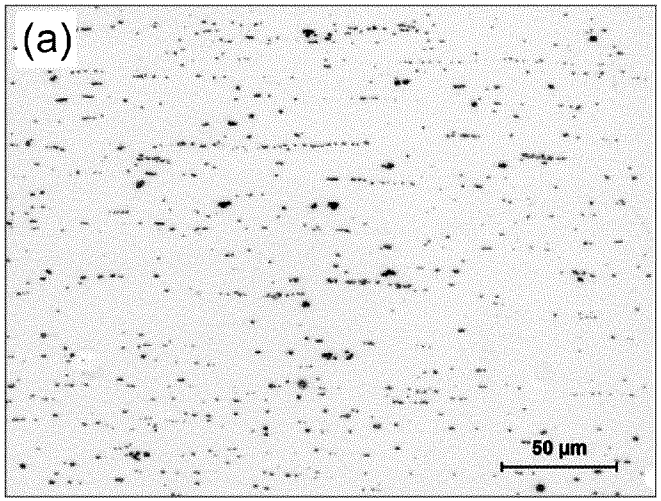
FIGS. 1A to D provide the optical micrographs showing the particles distribution of the alloys: (A) Al-0.3Fe, (B) Al-0.3Fe-0.29Cu, (C) Al-0.7Fe, and (D) Al-0.7Fe0.18Cu-0.1Mg, showing fine Fe-rich intermetallic particles distributed along the extrusion direction (ED).
Figure 1B:
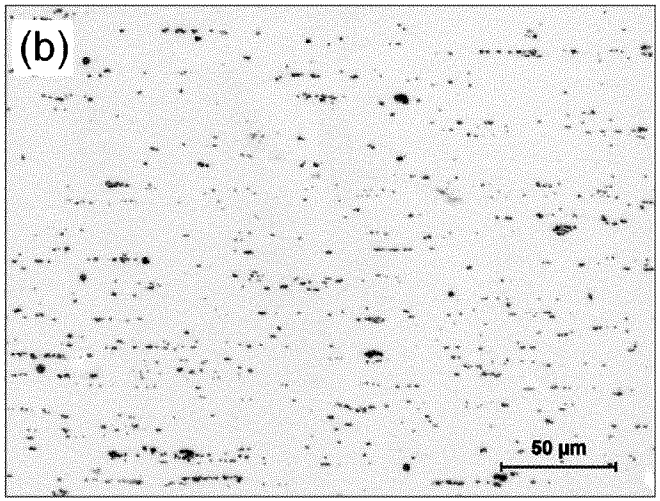
Figure 1C:
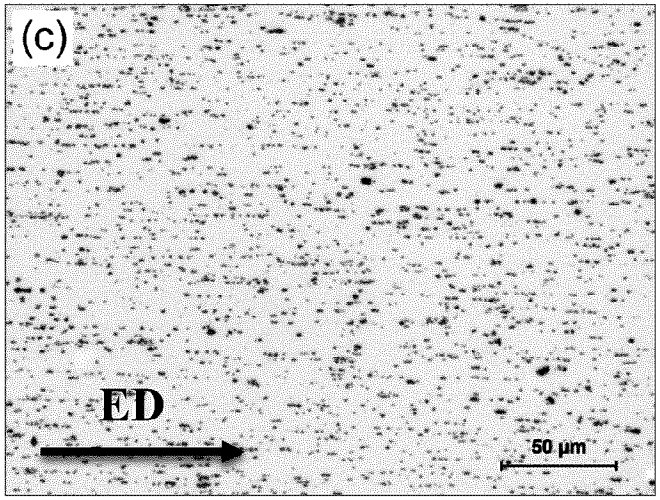
Figure 1D:
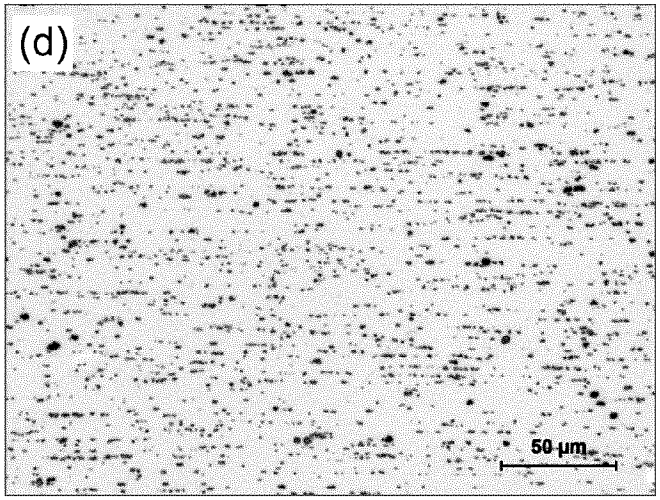

The present disclosure concerns the use of Mg in aluminum conductor alloys to increase creep resistance without substantially decreasing the electrical conductivity of the product comprising the aluminum conductor alloy. In some embodiments, the increase in creep resistance is observed at low temperatures (e.g., ≤0.4 temperature melting point or Tm). In some embodiments, the aluminum conductor alloys can also have a reduced Fe content which will facilitate casting operations without substantially decreasing the strength properties of the product comprising the aluminum conductor alloy.

In the context of the present disclosure, Mg can be added, at a weight percentage of between about 0.02 and 0.1 (in weight percent) to any aluminum conductor alloys to increase the creep resistance of said aluminum conductor alloy and without substantially decreasing the electrical conductivity of said aluminum conductor alloy. In an embodiment, the addition of Mg can be coupled with a decrease in the Fe content the aluminum conductor alloy of the present disclosure can be limited to 0.5 or even 0.3 (in weight percent). For example, Mg can be added to the wrought alloys of the 8xxx series (such as, for example, the aluminum alloys of the 8030 series) and to the wrought alloy of the 1xxx series (such as, for example, the aluminum alloys of the 1350 series).

One of the advantages of the aluminum conductor alloys of the present disclosure is that, once cast, they exhibit increased creeping resistance when compared to another aluminum conductor alloy comprising less than 0.02 Mg (in weight percent). Since the aluminum conductor alloys of the present disclosure are intended to be used at low temperatures, this increase in creep resistance is preferably observed at low temperatures (e.g., ≤0.4 Tm of the aluminum conductor alloy). In an embodiment, the increase in creep resistance occurs at temperatures between about 20° C. to about 200° C. or between about 50° C. to about 150° C. As it is known in the art, creep is characterized by three stages: primary, secondary and tertiary creep. During the primary creep, strain rates are relatively high, but reduce over time. During secondary creep, strain rates are stable. Secondary creep strain rates are typically used to characterize the "creep strain rate" of a material, such as an aluminum conductor alloy. During tertiary creep, necking occurs which leads to failure of the alloy. Creep can be determined by the absolute strain measured or the strain rate measured. In an embodiment, an aluminum product made from the aluminum conductor alloy of the present disclosure (when compared to a corresponding aluminum product made from an aluminum conductor alloy having no deliberate addition of Mg or having less than 0.02 Mg (in weight percent)) has a decreased minimum creep rate (e.g. the average creep rate during the secondary creep) or secondary creep rate, a decreased short-term creep deformation or primary creep rate, a decreased typical compressive creep strain and/or a decreased instantaneous creep rate. In some embodiments, the aluminum conductor alloys of the present disclosure have a secondary creep rate of at most (e.g., a maximal secondary creep rate) about $1\times10^{-8}$/s when measured at 100° C. under a 69 MPa load. The aluminum conductor alloys described herein have at most 0.1 Mg (in weight percent) in other to preserve the electrical conductivity of the alloy.

A further advantage of some of the aluminum conductor alloys of the present disclosure is that, if they comprise 0.5 Fe (in weight percent) or less (such as, for example less than about 0.5 or less than about 0.3 Fe, in weight percent), the aluminum conductor alloy will have improved casting properties, e.g., it will be easier and/or faster to cast (when compared to corresponding aluminum conductor alloys having more than 0.5 Fe, in weight percent).

Because the aluminum conductor alloys of the present disclosure are intended to be used as electrical conductor material, in some embodiments, they can exhibit an ultimate tensile strength (UTS) between about 115 and 145 MPa as well as an electrical conductivity EC of at least 58% IACS.

The aluminum conductor alloys of the present disclosure can optionally comprise silicon (Si). In an embodiment, the aluminum conductor alloys comprise, in weight percent, up to about (e.g., a maximum of) 0.1 Si (in weight percent). In another embodiment, the aluminum conductor alloys comprise, in weight percent, up to about (e.g., a maximum of) 0.01, 0.02, 0.03, 0.04, 0.05, 0.06, 0.07, 0.08, 0.09 or 0.1 Si (in weight percent). In yet another embodiment, the aluminum conductor alloys comprise, in weight percent, up to about (e.g. a maximum of) 0.01, 0.02, 0.03, 0.04 or 0.05 Si (in weight percent). In still another embodiment, the aluminum conductor alloys comprise, in weight percent, up to about (e.g. a maximum of) 0.05 Si (in weight percent). In some embodiments, the aluminum conductor alloys comprise, in weight percent, about 0.05 Si (in weight percent).

The aluminum alloy of the present disclosure can optionally comprise iron (Fe). In an embodiment, the aluminum conductor alloys comprise, in weight percent, up to about (e.g., a maximum of) 0.5 Fe (in weight percent). In yet a further embodiment, the aluminum conductor alloys comprise, in weight percent, up to about (e.g. a maximum of) 0.1, 0.2, 0.3, 0.4 or 0.5 Fe (in weight percent). In yet a further embodiment, the aluminum conductor alloys comprise, in weight percent, up to about (e.g. a maximum of) 0.1, 0.2, 0.3 or 0.4 Fe (in weight percent). In yet a further embodiment, the aluminum conductor alloys comprise, in weight percent, up to about (e.g. a maximum of) 0.1, 0.2 or 0.3 Fe (in weight percent). In some embodiments, the aluminum alloys of the present disclosure comprise at least about (e.g., a minimum of) 0.3 Fe (in weight percent). In a further embodiment, the aluminum conductor alloys of the present disclosure comprise at least about 0.3 Fe and at up to about 0.4 or 0.5 Fe, for example, between about 0.3 Fe and about 0.4, between about 0.3 Fe and about 0.5 Fe (in weight percent). In embodiments in which improving the cast properties of the aluminum conductor alloy is preferred, the aluminum alloy comprises up to about 0.5 Fe or up to about 0.3 Fe (for example, between about 0.3 and about 0.5 Fe or between about 0.3 and about 0.4 Fe, in weight percent).

The aluminum conductor alloys of the present disclosure optionally comprise copper (Cu). The presence of Cu can increase primary creep resistance and can also increase ultimate tensile strength (UTS) in the resulting cast product. In an embodiment, the aluminum conductor alloys comprise up to about (e.g., a maximum of) 0.35 Cu (in weight percent). For example, the aluminum conductor alloys of the present disclosure can comprise up to about (e.g., a maximum of) 0.05, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34 or 0.35 Cu (in weight percent). In some embodiments, the aluminum conductor alloys of the present disclosure comprise up to about (e.g., a maximum of) 0.30 Cu (in weight percent). For example, the aluminum conductor alloys can comprise up to about (e.g., a maximum of) 0.05, 0.06, 0.07, 0.08, 0.09, 0.10, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29 or 0.30 Cu (in weight percent). In an embodiment, the aluminum conductor alloys comprises between about 0.15 and about 0.30 Cu (in weight percent). In a further embodiment, the aluminum conductor alloys comprise at least about (e.g., a minimum of) 0.15, 0.16, 0.17, 0.18, 0.19, 0.20, 0.21, 0.22, 0.23, 0.24, 0.25, 0.26, 0.27, 0.28 or 0.29 Cu (in weight percent). In still another embodiment, the aluminum alloys comprise up to about (e.g., a maximum of) 0.30, 0.29, 0.28, 0.27, 0.26, 0.25, 0.24, 0.23, 0.22, 0.21, 0.20, 0.19, 0.18, 0.17 or 0.16 Cu (in weight percent). In yet another embodiment, the aluminum alloys comprise between about 0.15, 0.16, 0.17, 0.18, 0.19, 0.20, 0.21, 0.22, 0.23, 0.24, 0.25, 0.26, 0.27, 0.28 or 0.29 and about 0.30, 0.29, 0.28, 0.27, 0.26, 0.25, 0.24, 0.23, 0.22, 0.21, 0.20, 0.19, 0.18, 0.17 or 0.16 Cu (in weight percent). In an embodiment, the aluminum conductor alloys can comprise between about (e.g., a maximum of) 0.05, 0.06, 0.07, 0.08, 0.09, 0.1, 0.11, 0.12, 0.13, 0.14, 0.15, 0.16 or 0.17 and about 0.18, 0.17, 0.16, 0.15, 0.14, 0.13, 0.12, 0.11, 0.10, 0.09, 0.08, 0.07 or 0.06 Cu (in weight percent). In still another embodiment, the aluminum conductor alloys can comprise about 0.18 Cu (in weight percent).

The aluminum conductor alloys of the present disclosure comprise a deliberate addition of magnesium (Mg). As indicated above, the presence of Mg increases creep resistance in the resulting cast product. In an embodiment, the aluminum conductor alloys comprise up to about (e.g., a maximum of) 0.10 Mg, for example between about 0.02 and 0.10 Mg (in weight percent). For example, the aluminum conductor alloys of the present disclosure can comprise up to about (e.g., a maximum of) 0.02, 0.03, 0.04, 0.05, 0.06, 0.07, 0.08, 0.09 or 0.1 Mg (in weight percent). In some embodiments, the aluminum conductor alloys of the present disclosure comprise up to about (e.g., a maximum of) 0.1 Mg (in weight percent). In an embodiment, the aluminum conductor alloys comprises between about 0.02 to about 0.1 Mg (in weight percent). In a further embodiment, the aluminum conductor alloys comprise at least about (e.g., a minimum of) 0.02, 0.03, 0.04, 0.05, 0.06, 0.07, 0.08 or 0.09 Mg (in weight percent). In still another embodiment, the aluminum alloys comprise up to about (e.g., a maximum of) 0.1, 0.09, 0.08, 0.07, 0.06, 0.05, 0.04 or 0.03 Mg (in weight percent). In yet another embodiment, the aluminum alloys comprise between about 0.02, 0.03, 0.04, 0.05, 0.06, 0.07, 0.08 or 0.09 and about 0.1, 0.09, 0.08, 0.07, 0.06, 0.05, 0.04 or 0.03 Mg (in weight percent). In an embodiment, the aluminum conductor alloys can comprise up to about (e.g., a maximum of) 0.02, 0.03, 0.04, 0.05, 0.051 or 0.052 Mg (in weight percent). In still another embodiment, the aluminum conductor alloys can comprise about 0.0.052 Mg (in weight percent). In an embodiment, the aluminum conductor alloys can comprise up to about (e.g., a maximum of) 0.02, 0.021, 0.022, 0.023, 0.024 or 0.025 Mg (in weight percent). In still another embodiment, the aluminum conductor alloys can comprise about 0.025 Mg (in weight percent).

The aluminum conductor alloys of the present disclosure can optionally comprise boron (B). For example, the aluminum conductor alloys of the present disclosure can comprise between about 0.001 and about 0.04 B (in weight percent). In a further embodiment, the aluminum conductor alloys comprise at least about (e.g., a minimum of) 0.001, 0.002, 0.003, 0.004, 0.005, 0.006, 0.007, 0.008, 0.009, 0.01, 0.011, 0.012, 0.013, 0.014, 0.015, 0.016, 0.017, 0.018, 0.019, 0.02, 0.021, 0.022, 0.023, 0.024, 0.025, 0.026, 0.027, 0.028, 0.029, 0.03, 0.031, 0.032, 0.033, 0.034, 0.035, 0.036, 0.037, 0.038 or 0.039 B (in weight percent). In still another embodiment, the aluminum conductor alloys comprise up to about (e.g., a maximum of) 0.04, 0.039, 0.038, 0.037, 0.036, 0.035, 0.034, 0.033, 0.032, 0.031, 0.03, 0.029, 0.028, 0.027, 0.026, 0.025, 0.024, 0.023, 0.022, 0.021, 0.02, 0.019, 0.018, 0.017, 0.016, 0.015, 0.014, 0.013, 0.012, 0.011, 0.01, 0.009, 0.008, 0.007, 0.006, 0.005 or 0.004 B. In yet another embodiment, the aluminum conductor alloys comprise between about 0.003, 0.004, 0.005, 0.006, 0.007, 0.008, 0.009, 00.1, 0.011, 0.012, 0.013, 0.014, 0.015, 0.016, 0.017, 0.018, 0.019, 0.02, 0.021, 0.022, 0.023, 0.024, 0.025, 0.026, 0.027, 0.028 or 0.029 and about 0.03, 0.029, 0.028, 0.027, 0.026, 0.025, 0.024, 0.023, 0.022, 0.021, 0.02, 0.019, 0.018, 0.017, 0.016, 0.015, 0.014, 0.013, 0.012, 0.011, 0.01, 0.009, 0.008, 0.007, 0.006, 0.005, 0.004, 0.003 or 0.002 B (in weight percent).

The balance of the aluminum alloy of the present disclosure is aluminum (Al) and unavoidable impurities. In an embodiment, each impurity is present, in weight percent, at a maximum of about 0.03 and the total unavoidable impurities is present, in weight percent, at less than about 0.10 (in weight percent).

The aluminum conductor alloys of the present disclosure can be provided as rods. Rods can be cast from a continuous rod casting machine or from extruded billets. The rods can be worked into wires.

The aluminum conductor alloys of the present disclosure can be used in making electrical conductors. As indicated herein aluminum products, such as electrical conductors, comprising the aluminum conductor alloys of the present disclosure exhibit increased creep resistance in comparison with electrical conductors made from an aluminum conductor alloy comprising less than 0.02 Mg (in weight percent).

The present disclosure also provides a process for improving the creep resistance of an aluminum product when compared to a control aluminum product. In the context of the present disclosure, an improvement of the creep resistance refers to the reduction of the secondary creep rate. In an embodiment, the aluminum conductor alloys of the present disclosure exhibits a maximal secondary creep rate of at most $1\times10^{-8}$/s at 100° C. under a 69 MPa load. In the process, the aluminum product is made from or comprises the aluminum alloy of the present disclosure (comprising at least about 0.02 Mg as a deliberate addition) whereas the control aluminum product is made from or comprises a first aluminum alloy (lacking Mg as a deliberate addition or having less than 0.02 Mg). The process comprises adding Mg (at the weight percent described above) to a first aluminum alloy (comprising Fe and Cu and optionally Si and/or B, each at the weight percent described above) to provide the modified aluminum alloy (comprising Fe, Cu and Mg and optionally Si and/or B, each at the weight percent described above). In the context of the present disclosure, the term "aluminum product" can refer to a final cast products or to an intermediary rod which can further be worked into a differently shaped aluminum product. As such, the process can further comprise casting or working the aluminum conductor alloy into the aluminum product. In the embodiments in which the aluminum product is a cast product, the latter can be an electrical conductive material, such as an electrical conductor. The present disclosure also provides an aluminum product obtainable or obtained by the process described herewith.

The present disclosure also provides a process for making an aluminum product having an improved creep resistance when compared to a control aluminum product lacking a deliberate addition of Mg or having less than 0.02 Mg (in weight percent). The process comprises working the aluminum alloy or the modified aluminum conductor alloy described herewith or the rod described herewith into the aluminum product. The working step can include casting the aluminum alloy directly into a cast product or intermediary rods. As such, in the context of the present disclosure, the term "aluminum product" can refer to a final cast products or to an intermediary rod which can further be worked into a differently shaped aluminum product. In the embodiments in which the aluminum product is a cast product, the latter can be an electrical conductive material, such as an electrical conductor, a wire for example.

The present invention will be more readily understood by referring to the following examples which are given to illustrate the invention rather than to limit its scope.

Example I—Creep Resistance Determination

The materials used in this example were 8xxx aluminum alloys with three fixed Fe levels (Al-0.3Fe, Al-0.5Fe and Al-0.7Fe base alloys), alloyed with various Cu and Mg concentrations. The addition of 0.18% and 0.29% Cu were made to Al-0.3Fe, Al-0.5Fe and Al-0.7Fe base alloys, and further addition of 0.025%, 0.05% and 0.1% Mg were made to Al-0.3Fe-0.18Cu, Al-0.5Fe-0.18Cu and Al-0.7Fe-0.18Cu alloys, respectively. A total of 18 alloys with various Cu, Mg and Fe contents were batched in an electrical resistant furnace and cast in the form of round billets with 4 inches in diameter by a direct chill (DC) cast units. The chemical composition of each of the 18 alloys (L00 to H210) is shown in Table 1 (all alloy compositions are in wt. % unless otherwise indicated). All the rod samples with 9.5 mm in diameter, which are equivalent to the industrial 9.5 mm supply rods for drawn wire, were produced by the hot extrusion from DC cast billets.

TABLE 1

Chemical compositions of the experimental alloys investigated (wt. %)

| Alloys | Fe | Cu | Mg | Si | Mn | Cr | Zn | Al |
|---|---|---|---|---|---|---|---|---|
| Al—0.3Fe (L00) | 0.30 | 0.01 | 0.001 | 0.025 | 0.002 | 0.001 | 0.012 | Bal. |
| Al—0.3Fe—0.18Cu (L20) | 0.30 | 0.18 | 0.001 | 0.023 | 0.003 | 0.001 | 0.002 | Bal. |
| Al—0.3Fe—0.29Cu (L30) | 0.30 | 0.29 | 0.000 | 0.033 | 0.001 | 0.001 | 0.012 | Bal. |
| Al—0.3Fe0.18Cu—0.03Mg (L23) | 0.30 | 0.18 | 0.025 | 0.031 | 0.002 | 0.001 | 0.012 | Bal. |
| Al—0.3Fe0.18Cu—0.05Mg (L25) | 0.30 | 0.19 | 0.052 | 0.038 | 0.003 | 0.001 | 0.002 | Bal. |
| Al—0.3Fe0.18Cu—0.1Mg (L210) | 0.30 | 0.18 | 0.100 | 0.049 | 0.002 | 0.001 | 0.012 | Bal. |
| Al—0.5Fe (M00) | 0.46 | 0.01 | 0.001 | 0.046 | 0.002 | 0.001 | 0.012 | Bal. |
| Al—0.5Fe—0.18Cu (M20) | 0.50 | 0.18 | 0.001 | 0.027 | 0.004 | 0.001 | 0.002 | Bal. |

TABLE 1-continued

Chemical compositions of the experimental alloys investigated (wt. %)

| Alloys | Fe | Cu | Mg | Si | Mn | Cr | Zn | Al |
|---|---|---|---|---|---|---|---|---|
| Al—0.5Fe—0.29Cu (M30) | 0.47 | 0.29 | 0.000 | 0.023 | 0.002 | 0.001 | 0.003 | Bal. |
| Al—0.5Fe0.18Cu—0.03Mg (M23) | 0.46 | 0.18 | 0.026 | 0.051 | 0.002 | 0.001 | 0.013 | Bal. |
| Al—0.5Fe0.18Cu—0.05Mg (M25) | 0.44 | 0.17 | 0.055 | 0.021 | 0.001 | 0.001 | 0.002 | Bal. |
| Al—0.5Fe0.18Cu—0.1Mg (M210) | 0.47 | 0.18 | 0.100 | 0.049 | 0.002 | 0.001 | 0.012 | Bal. |
| Al—0.7Fe (H00) | 0.70 | 0.01 | 0.001 | 0.023 | 0.002 | 0.001 | 0.013 | Bal. |
| Al—0.7Fe—0.18Cu (H20) | 0.70 | 0.19 | 0.001 | 0.042 | 0.003 | 0.001 | 0.016 | Bal. |
| Al—0.7Fe—0.29Cu (H30) | 0.71 | 0.29 | 0.000 | 0.032 | 0.003 | 0.001 | 0.002 | Bal. |
| Al—0.7Fe0.18Cu—0.03Mg (H23) | 0.69 | 0.18 | 0.027 | 0.052 | 0.002 | 0.001 | 0.013 | Bal. |
| Al—0.7Fe0.18Cu—0.05Mg (H25) | 0.70 | 0.18 | 0.056 | 0.042 | 0.003 | 0.001 | 0.012 | Bal. |
| Al—0.7Fe0.18Cu—0.1Mg (H210) | 0.72 | 0.18 | 0.100 | 0.051 | 0.002 | 0.001 | 0.013 | Bal. |

The electrical conductivity measurement was directly conducted on the samples of 9.5 mm in diameter and 200 mm long using Megger DLRO10HD resistance ohmmeter. Tensile test was carried out on cylindrical specimens (9.5 mm in diameter and 250 mm in length) according to ASTM B557 standard at room temperature. The compression creep tests were conducted on cylindrical specimens (with a diameter of 9.5 mm and a length of 19 mm) at 100° C. for 100 hours under a constant load 69 MPa. To confirm the reliability of the results, 3 tests were repeated for each condition.

For microstructure examination, the extruded rods were first cut 20 mm in length and then sectioned longitudinally along the centerline. All the samples were polished and etched by the Keller's solution for 10 seconds and then were observed using optical microscope (OM), scanning electron microscope (SEM) and electron backscattered diffraction (EBSD) technique. The automated EBSD maps were conducted on the deformed structure with step size of 0.2 μm using HKL Channel 5 software for substructure analysis. The linear intercept method (as described in F. J. Humphreys, J. Mater. Sci. 36 (2001) 3833-3854, C. J. Shi, W. M. Mao, X. G. Chen, Mater. Sci. Eng. A 571 (2013) 83-91) was used to measure the subgrain size of alloys with different alloying contents. To ensure statistical reliability, more than 200 subgrains were measured in each sample.

Microstructure evolution. FIGS. 1(A) to 1(D) show optical micrographs of some typical alloys with different compositions after extrusion ((A) Al-0.3Fe, (B) Al-0.3Fe-0.29Cu, (C) Al-0.7Fe, and (D) Al-0.7Fe0.18Cu-0.1Mg). Due to a very low solubility of Fe in aluminum matrix, almost all the Fe precipitated out in the form of Fe-contained intermetallic networks in the cast microstructure. During hot extrusion, the Fe-contained intermetallic networks were broken down to a number of fine intermetallic dispersion particles. For all the alloys, the fine intermetallic particles, which were confirmed as $Al_mFe$, were uniformly distributed along the extrusion direction in aluminum matrix. With increasing amount of Fe, from 0.3 to 0.7%, in the three base alloys (Al-0.3Fe, Al-0.5Fe, Al-0.7Fe), the volume fraction of Fe-contained intermetallic particles was increased from 1.8% in Al-0.3Fe to 3.2% in Al-0.5Fe and further to 4.4% in Al-0.7Fe alloys. When Cu and Mg were added to the three base alloys, the volume fraction of intermetallic particles were found to remain approximately unchanged compared to the corresponded base alloys. A comparison of FIGS. 1(A) and (B) shows the evolution of the particles distribution of the alloys for the addition of 0.29% Cu, and a comparison of FIGS. 1(C) and (D) shows the evolution of the particles distribution of the alloys for the combined addition of 0.18% Cu and 0.1% Mg. Without wishing to be bound to theory, this can be attributed to the higher solid solubility of Cu and Mg in aluminum, which is approximately 0.4% and 1.7% at room temperature, respectively. Therefore, Cu up to 0.29% and Mg up to 0.1% were expected to remain all in the solid solution after extrusion. On the other hand, the size of Fe-contained intermetallic particles was measured to be similar with an average value of 0.38 μm for all the alloys studied.

To understand the microstructure evolution with additions of Cu and Mg in 8xxx aluminum alloys, EBSD orientation maps of the same typical alloy samples as in FIG. 1 were examined. All the extruded alloys showed a characteristic of recovered structure (data not shown). A large amount of low-angle boundaries with misorientation angles between of 1° and 5° were observed, indicating a number of cells and subgrains. In addition, the substructures were organized and large well-defined subgrains were formed along the elongated grains with neatly arranged boundaries of 1-15°, suggesting that dynamic recovery happened, thereby involving the annihilation and rearrangement of dislocations.

Figure 2A:
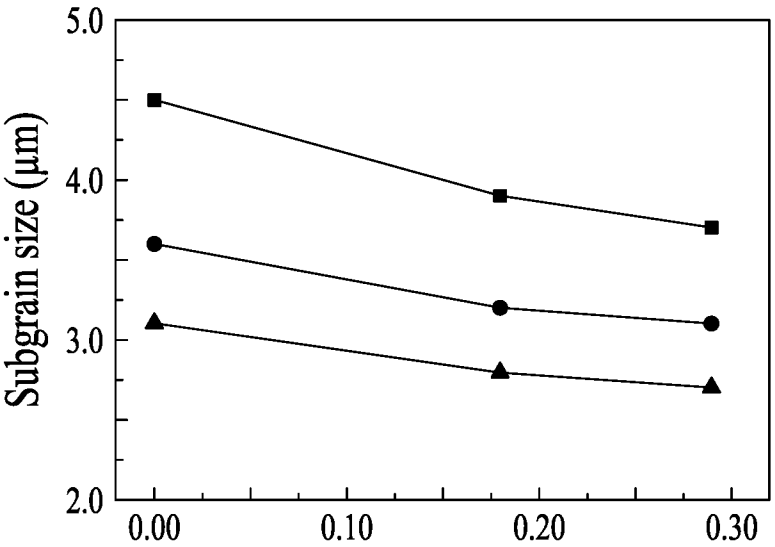
FIGS. 2A and B illustrate the evolution of subgrain size (in μm) with increasing of (A) Cu (■=Al-0.3Fe—Cu; •=Al-0.5Fe—Cu; ▲=Al-0.7Fe—Cu) and (B) Mg (■=Al-0.3Fe-0.18Cu—Mg; •=Al-0.5Fe-0.18Cu—Mg; ▲=Al-0.7Fe-0.18Cu—Mg) contents of different alloys.
Figure 2B:
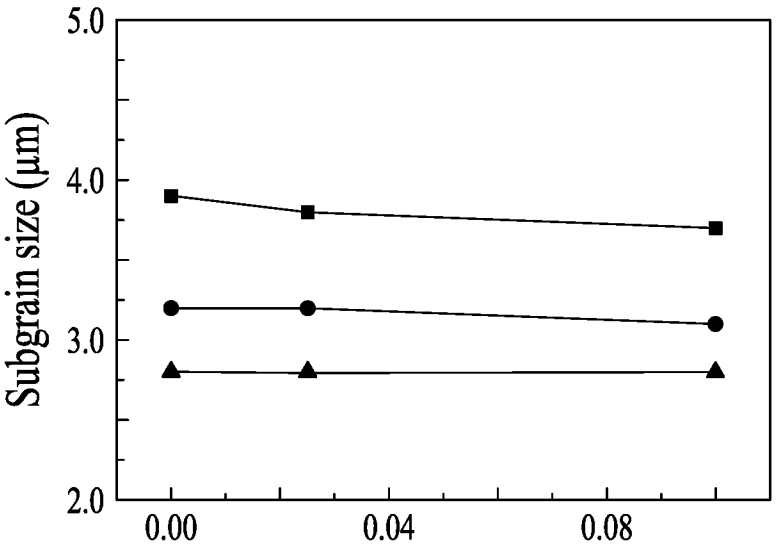

Though the recovered structure was present in all experimental alloys, differences in subgrain size were observed due to additions of Cu and Mg. In the present example, the average subgrain size was measured from the EBSD orientation maps and the results are illustrated in FIG. 2. It was found that the average subgrain size was decreased from 4.5 μm in Al-0.3Fe to 3.7 μm in Al-0.5Fe and further to 3.2 μm in Al-0.7Fe as the amount of Fe increased from 0.3% to 0.7% in the base alloys. On the other hand, with increasing Cu (0.18-0.29%), the subgrain size slightly decreased from 4.5 to 3.8 μm in Al-0.3Fe—Cu, from 3.7 to 3.3 μm in Al-0.5Fe—Cu and from 3.2 to 2.7 μm in Al-0.7Fe—Cu alloys (FIG. 2(A)), respectively. However, a further addition of Mg (0.025-0.1%) in all three base alloys showed almost no effect on subgrain size (FIG. 2(B)). Without wishing to be bound to theory, the decrease of the subgrain size with increasing Fe content in the base alloys can be interpreted by the increase of the volume fraction of Fe-contained intermetallic particles, which had strong pinning effect on dislocation motion and subgrain growth. Besides, Cu solutes in aluminum solution have a lower diffusion rate than for aluminum self-diffusion, which would strongly hinder the dislocation movement at the subgrain boundaries and enhance dislocation multiplication, leading to the retardation of the dynamic recovery. However, the diffusion rate of Mg is very close to aluminum self-diffusion, which resulted in little effect on the dynamic recovery. As a result, with increasing Cu level the subgrain size decreased while the Mg addition exhibited no effect on subgrain size.

Figure 3B:
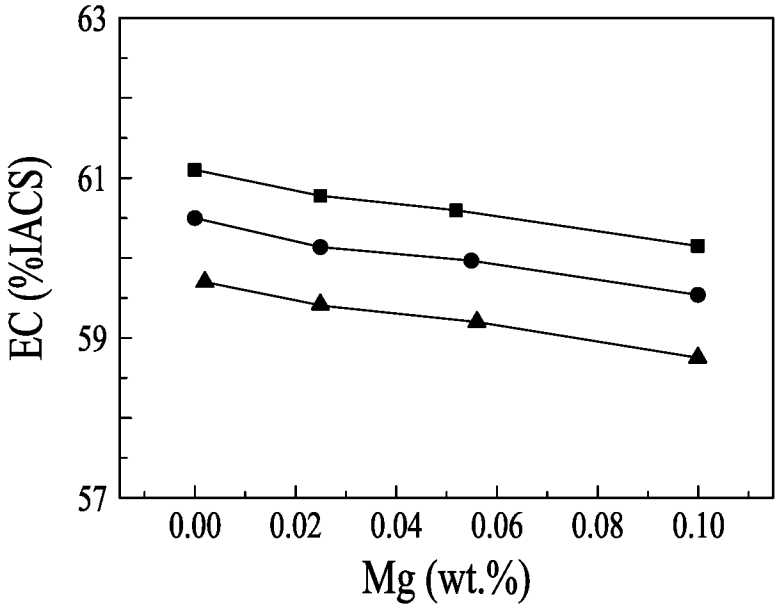
FIGS. 3A and B provide the individual influences of selected alloying elements on electrical conductivity (EC in % International Annealed Copper Standard, IACS): (A) Cu (■=Al-0.3Fe—Cu; •=Al-0.5Fe—Cu; ▲=Al-0.7Fe—Cu) and (B) Mg (■=Al-0.3Fe-0.18Cu—Mg; •=Al-0.5Fe-0.18Cu—Mg; ▲=Al-0.7Fe-0.18Cu—Mg).
Figure 3A:
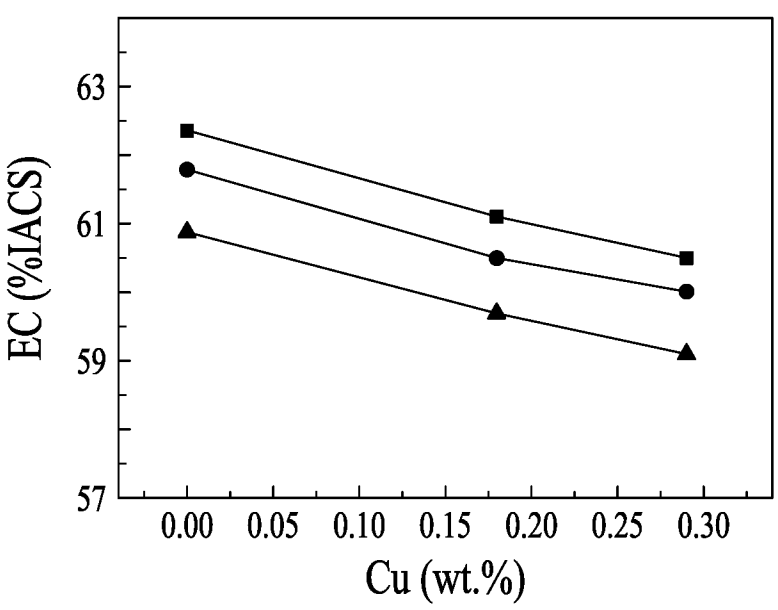

Effects of Cu and Mg on electrical conductivity and ultimate tensile strength. FIG. 3 shows the evolution of the electrical conductivity (EC) with different amounts of Cu and Mg in 8xxx aluminum alloys. It was found that EC slightly decreased with increasing Cu and Mg due to enhanced scattering of free electrons at Cu and Mg solutes in aluminum. With increasing Cu from 0 to 0.29%, EC decreased from 62.4 to 60.5% IACS in Al-0.3Fe—Cu alloy and from 60.9 to 59.1% IACS in Al-0.7Fe—Cu alloy (FIG. 3(A)), while with increasing Mg from 0% to 0.1%, EC decreases from 61.1 to 60.2% IACS in Al-0.3Fe0.18Cu—Mg alloy and from 59.7 to 58.8% IACS in Al-0.7Fe0.18Cu—Mg alloy (FIG. 3(B)), respectively.

In order to quantitatively analyze the experimental data, a Matthiessen's law (as described in B. Raeisinia, W. J. Poole, D. J. Lloyd, Mater. Sci. Eng. A 420 (2006) 245-249) was adapted to establish the relationship of the EC with chemical composition as follows:

$$\frac{1}{EC} = \rho_b + \sum_i \rho_i C_i + \rho_P f_P \quad \text{(Eq. 1)}$$

where EC is the electrical conductivity, $\rho_b$ is resistivity of the base alloy, $\Sigma_i \rho_i C_i$ is the sum of the resistivity contributions from the various solution additions, i.e. p, is the resistivity parameter and $C_i$ is the concentration of the $i^{th}$ solute, $\rho_p$ is the resistivity parameter of the particles to resistivity and $f_p$ is the particle volume fraction. In the present example, due to the low solubility of Fe in aluminum, it can be assumed that almost all the Fe precipitated out into intermetallic particles and the volume fraction of intermetallic particles has a close and linear relation with Fe contents. As all the alloys had similar particles size, the particle contribution $\rho_p f_p$ in Eq. 1 can be substituted by $\rho'_{Fe} C_{Fe}$. Consequently, Eq. 1 can be transformed to:

$$\frac{1}{EC} = \rho_b + \rho_{Cu} C_{Cu} + \rho_{Mg} C_{Mg} + \rho'_{Fe} C_{Fe} \quad \text{(Eq. 2)}$$

where EC is in the unit of % IACS, $\mu_{Cu}$, $\rho_{Mg}$ and $\rho'_{Fe}$ are the resistivity parameters of U, Mg and Fe alloying elements, and $C_{Cu}$, $C_{Mg}$ and $C_{Fe}$ are the concentrations in wt. %. Based on the results from FIG. 3, the values of all resistivity parameters (p) can be obtained using the multiple linear regression method. Subsequently, an empirical expression can be obtained to predict the electrical conductivity as a function of alloying element contents:

$$1/EC = 0.01575 + 0.00174 C_{Cu} + 0.00289 C_{Mg} + 0.00096 C_{Fe} \quad \text{(Eq. 3)}$$

Figure 4:
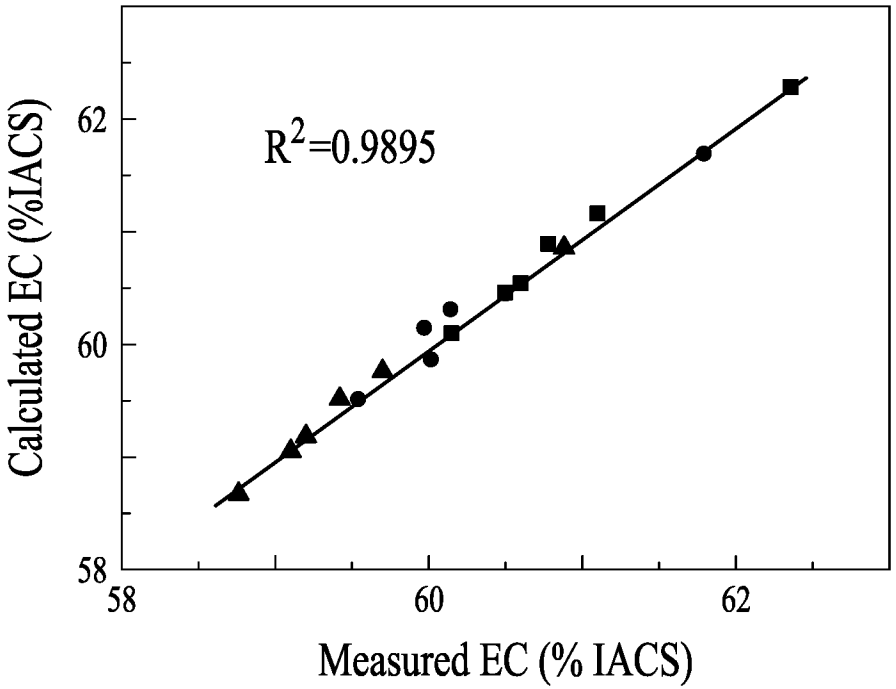
FIG. 4 provides a correlation between calculated and experimental measured EC (in % IACS) for alloys Al-0.3Fe—Cu—Mg (■), Al-0.5Fe—Cu—Mg (•) and Al-0.7Fe—Cu—Mg (▲).

Using Eq. 3, the values of EC can be calculated with different Cu, Mg and Fe contents for 8xxx aluminum alloys. In the present example, the calculated values of the electrical conductivity versus the measured values with different Cu and Mg contents in the three base alloys are plotted in FIG. 4 (Al-0.3Fe—Cu—Mg, Al-0.5Fe—Cu—Mg, Al-0.7Fe—Cu—Mg). As demonstrated, there is excellent agreement between the calculated and experimental results. Furthermore, to evaluate the accuracy of the equation 3, the error between the calculated EC(C) and the measured EC(M) can be expressed as follows:

$$\text{Error } \% = \left| \frac{EC(C) - EC(M)}{EC(M)} \right| 100 \quad \text{(Eq. 4)}$$

The mean error for the 8xxx alloys with Cu contents (ranging from 0% to 0.29%) and Mg contents (ranging from 0% to 0.1%) was determined to be 0.13%, which confirms again an excellent agreement between the predicted and measured EC. Therefore, the obtained equation 3 offers a very good prediction of the electrical conductivity as function of alloying elements (Cu, Mg and Fe) in 8xxx aluminum alloys.

Figure 5A:
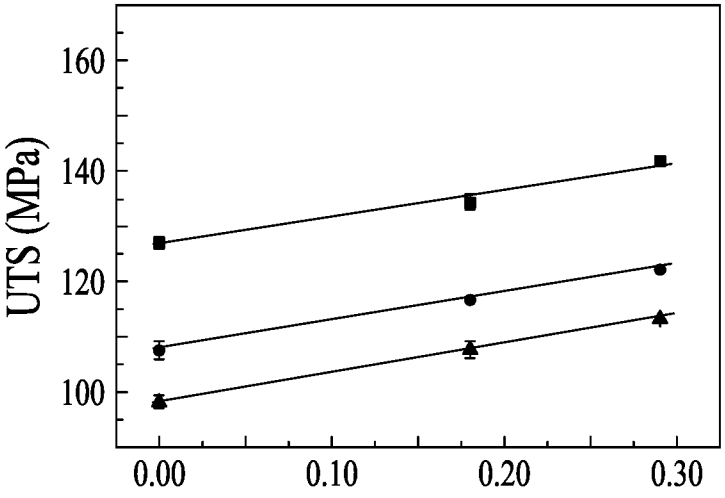
FIGS. 5A to C provide the individual influences of selected chemical elements on Ultimate Tensile Strength (UTS in MPa): (A) Cu (▲=Al-0.3Fe—Cu; ●=Al-0.5Fe—Cu; ■=Al-0.7Fe—Cu), (B) Mg (■=Al-0.3Fe-0.18Cu—Mg; •=Al-0.5Fe-0.18Cu—Mg; ▲=Al-0.7Fe-0.18Cu—Mg), and (C) Fe with a linear relationship (■=Al—Fe; ●=Al-0.29Cu—Fe; ▲=Al-0.18Cu-0.1 Mg—Fe).
Figure 5B:
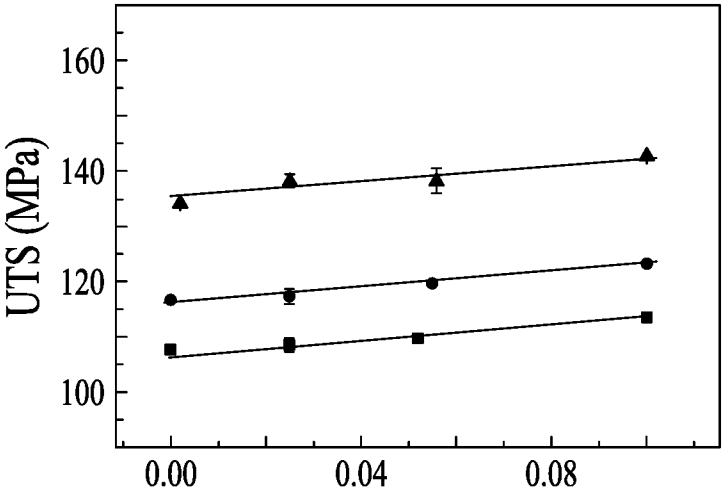
Figure 5C:
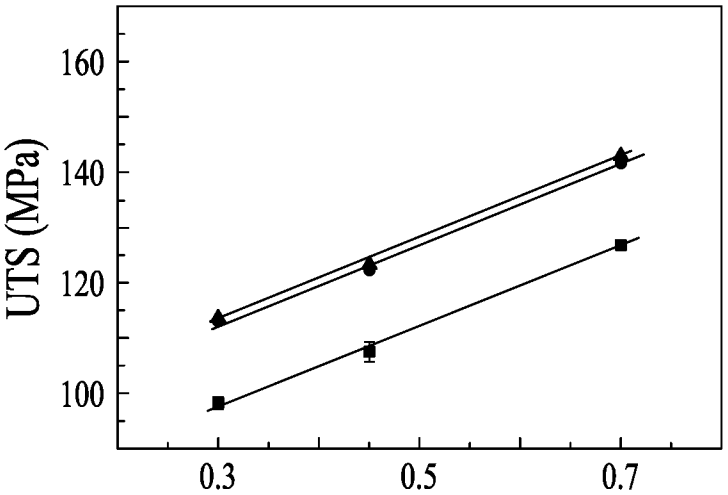

On the other hand, the UTS of the alloys were evaluated with different compositions and the results are shown in Table 2. It was found that UTS was moderately increased with increasing Cu and Mg concentrations most likely due to solid solution strengthening and substructure strengthening. The results also reveal a beneficial effect of Cu and Mg on the mechanical properties. Besides, the UTS showed a nearly linear relationship with Cu, Mg and Fe contents, as shown in FIG. 5. The overall strength σ (UTS) of the alloys can be expressed by an empirical equation in the form (as described in E. A. Marquis, D. N. Seidman, D. C. Dunand, Acta Mater. 51 (2003) 4751-4760 and R. A. Karnesky, L. Meng, D. C. Dunand, Acta Mater. 55 (2007) 1299-1308):

$$\sigma(UTS) = \sigma_b + H_{Cu} C_{Cu} + H_{Mg} C_{Mg} + H_{Fe} C_{Fe} \quad \text{(Eq. 5)}$$

where $\sigma_b$ is strength of the base alloy in the unit of MPa, $H_{Cu}$, $H_{Mg}$, and $H_{Fe}$ are the strengthening parameters of Cu, Mg and Fe, and $C_{Cu}$, $C_{Mg}$ and $C_{Fe}$ are the concentrations in wt. %. By using the multiple linear regression method, the value of ab and strengthening parameters (H) were determined to be 75.6 for $\sigma_b$, 51.1 for $H_{Cu}$, 66.7 for $H_{Mg}$ and 71.0 for $H_{Fe}$, respectively. Then, the equation can be used to describe the UTS as a function of alloying element contents:

$$UTS = 75.6 + 51.1 C_{Cu} + 66.7 C_{Mg} + 71.0 C_{Fe} \quad \text{(Eq. 6)}$$

Figure 6:
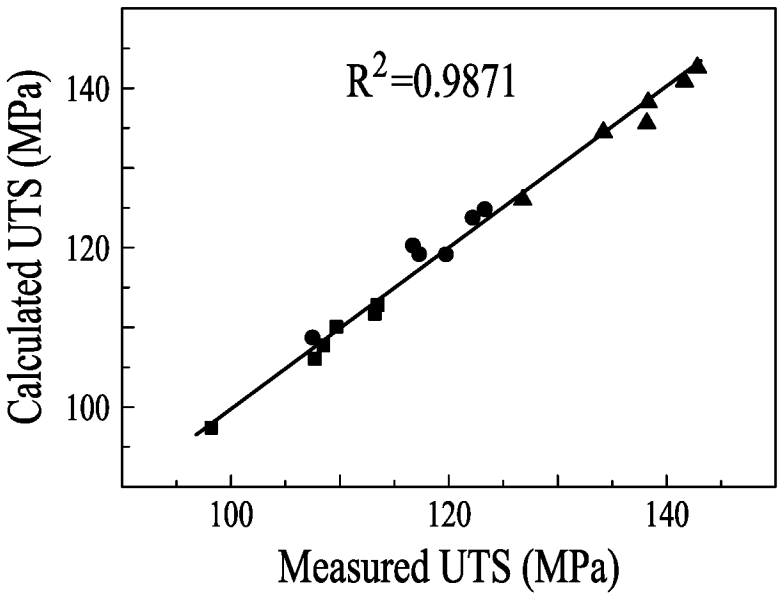
FIG. 6 provides the correlation between calculated and experimental measured UTS (in MPa) for alloys (■=Al-0.3Fe—Cu—Mg; •=Al-0.5Fe—Cu—Mg; ▲=Al-0.7Fe—Cu—Mg).

According to Eq. 6, the values of UTS with different Cu, Mg and Fe contents can be calculated. The calculated values of the UTS versus the measured values for the 8xxx alloys with various Cu, Mg and Fe contents in different base alloys were plotted in FIG. 6, which demonstrated good agreement between the calculated and experimentally measured results. Besides, the mean error between the calculated UTS(C) and the measured UTS(M) for the 8xxx alloys with addition of Cu (0-0.29%) and Mg (0-0.1%) was determined to be 1.0%, which confirmed the agreement between the calculated and measured UTS. Therefore, the obtained equation 6 could be used to calculate the UTS of 8xxx aluminum alloys after alloying with various Cu, Mg and Fe additions.

TABLE 2

The variations of UTS with Cu and Mg in different base alloys.

| Alloys | UTS (MPa) | Alloys | UTS (MPa) | Alloys | UTS (MPa) |
|---|---|---|---|---|---|
| L00 | 98.2 | M00 | 107.5 | H00 | 126.8 |
| L20 | 107.7 | M20 | 116.7 | H20 | 134.2 |
| L30 | 113.2 | M30 | 122.2 | H30 | 141.6 |
| L23 | 108.5 | M23 | 117.3 | H23 | 138.2 |
| L25 | 109.7 | M25 | 119.7 | H25 | 138.3 |
| L210 | 113.5 | M210 | 123.3 | H210 | 142.8 |

Figure 7:
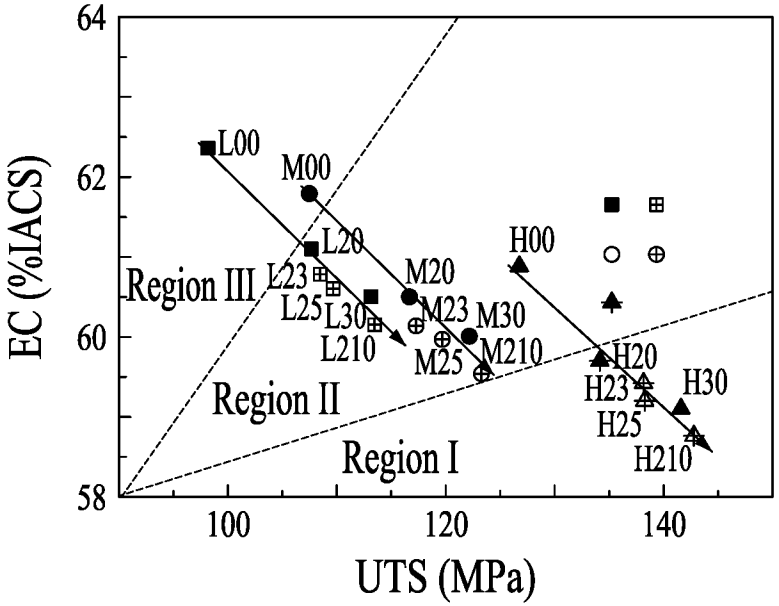
FIG. 7 provides the EC (in % IACS) and UTS (in MPa) profile of the alloys (■/⊞=Al-0.3Fe—Cu—Mg; ■/⊕=Al-0.5Fe—Cu—Mg; ▲/⊞=Al-0.7Fe—Cu—Mg) with different Cu and Mg additions. Arrows show the increasing Cu and Mg additions to their corresponding regions.

From Eqs. 3 and 6, the EC and UTS could be quantitatively calculated according to Cu, Mg and Fe contents. For aluminum conductor alloys, high EC with enhanced UTS are most desirable properties in 8xxx aluminum alloys. However, high EC and high UTS are usually opposite because of the metallurgical nature of both properties. The EC and UTS profile of the alloys with different Cu and Mg additions in Al-0.3Fe, Al-0.5Fe and Al-0.7Fe base alloys were plotted in FIG. 7. This figure can be divided into three regions with different combinations of EC and UTS. The region I is with high UTS but low EC while the region Ill is with high EC but low UTS. The region II in the middle has a balanced EC and UTS. In the present study, both 0.3Fe (L00) and 0.5Fe (M00) alloys have higher EC but lower UTS (region Ill) compared to 0.7Fe (HOO) alloy (region II). With additions of Cu and Mg, 0.3Fe and 0.5Fe alloys moved to the region II with a balanced EC and UTS. For example, 0.5Fe alloys with Cu and Mg additions could possibly have a similar value of EC and UTS compared with 0.7Fe (HOO) alloy. It is also evident that 0.7 alloys with Cu and Mg additions tend to move from the region I to the region I, which have higher UTS but relatively lower EC. By adjusting Fe and Cu and Mg alloying elements, different combinations of EC and UTS could be obtained to fulfill different design requirements for specific product applications.

Figure 8B:
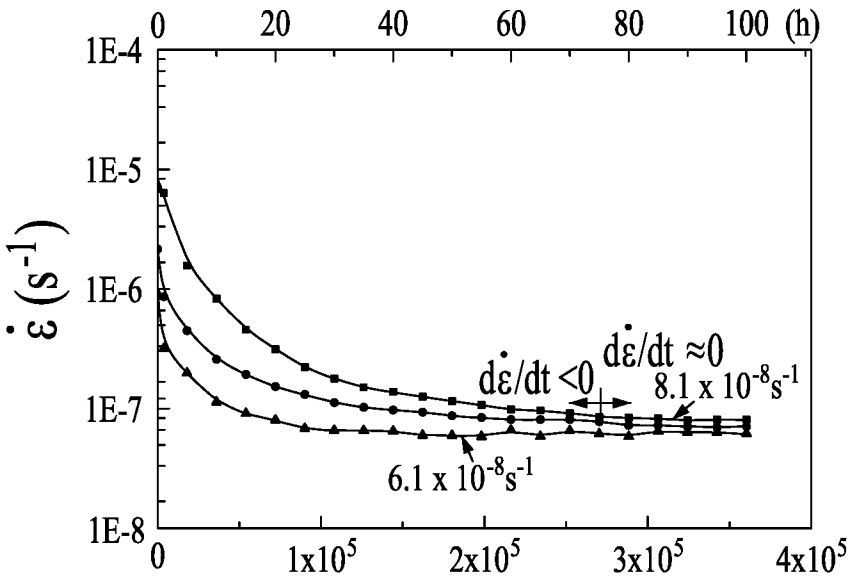
FIGS. 8A and B provide the typical compressive creep strain (ε) (A) and instantaneous creep rate ($\dot{\varepsilon}$) (B) curves of Al-0.3Fe alloys with Cu addition (■=Al-0.3Fe (base); •=Al-0.3Fe-0.18Cu; ▲=Al-0.3Fe-0.29Cu), tested at 100° C. and applied load of 69 MPa.
Figure 8A:
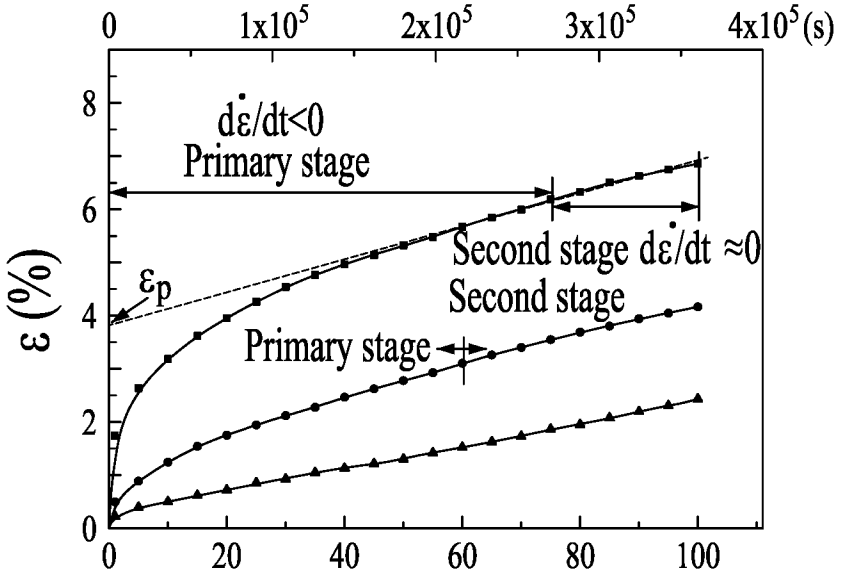

Effects of Cu and Mg on creep properties. FIG. 8 shows typical creep strain (s) and instantaneous creep rate ($d\varepsilon/dt$ or $\dot{\varepsilon}$) curves of Al-0.3Fe alloys with Cu additions, tested at 100° C. under a constant load of 69 MPa. It can be seen that the total creep strain greatly decreases from 6.87% in Al-0.3Fe base alloy to 2.44% in Al-0.3Fe-0.29Cu alloy (FIG. 8(A)). In general, during the compressive creep deformation, the creep strain rapidly increases with increasing time at the beginning of creep deformation due to an initial high rate of work hardening (defined as the primary stage, where $d\dot{\varepsilon}/dt<0$). Subsequently, the creep deformation runs to a quasi-steady state, in which the creep rate, $d\varepsilon/dt$, becomes more and less constant (namely the second stage, $d\dot{\varepsilon}/dt\approx0$). It is suggested the second stage dominates the creep deformation during the long-term creep process. As shown in FIG. 8(B), the minimum creep rate ($\dot{\varepsilon}_m$ in $s^{-1}$) is calculated as the average creep rate in the second stage, and the results show that with increasing Cu content from 0% to 0.29%, the $\dot{\varepsilon}_m$ slightly decreased from $8.1\times10^{-8}$ to $6.1\times10^{-8}$ $s^{-1}$. The results from FIG. 8 indicated that addition of Cu was mainly beneficial at the primary creep stage but has very little effect at second creep stage.

Figure 9A:
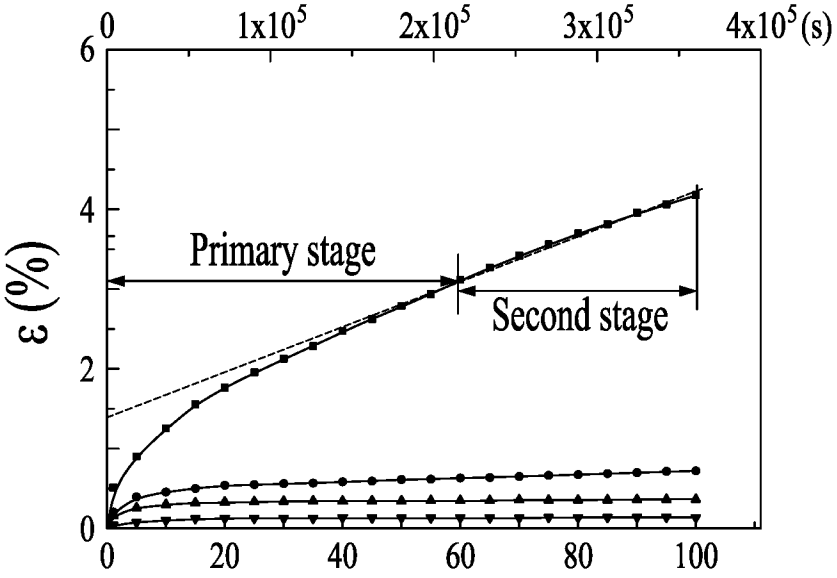
FIGS. 9A and B provide the typical compressive creep strain (ε in %) (A) and instantaneous creep rate ($\dot{\varepsilon}$ in $s^{-1}$) curves (B) of Al-0.3Fe-0.18Cu alloys with Mg addition (■=Al-0.3Fe-0.18Cu; •=Al-0.3Fe-0.18Cu-0.025Mg; ▲=Al-0.3Fe-0.18Cu-0.052Mg; ▼=Al-0.3Fe-0.18Cu-0.1Mg), tested at 100° C. and applied load of 69 MPa.
Figure 9B:
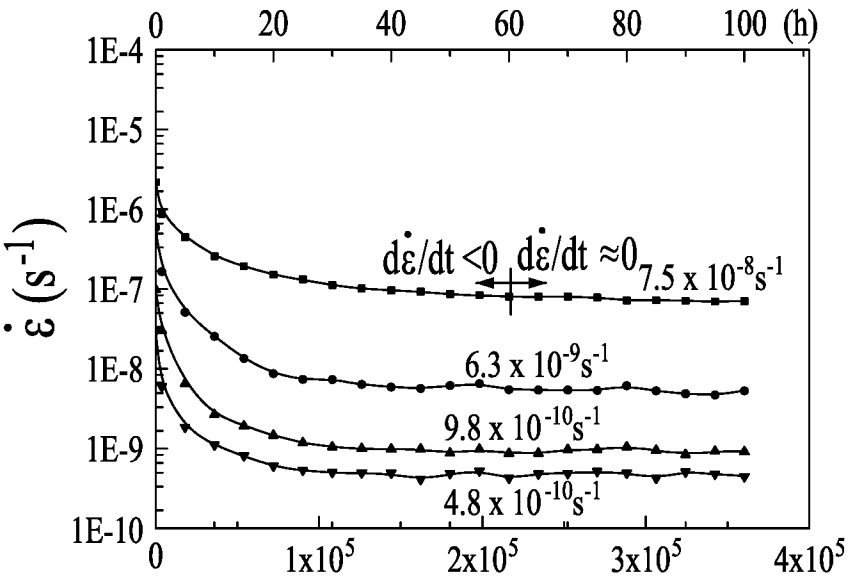

FIG. 9 shows typical creep strain (s) and instantaneous creep rate ($d\varepsilon/dt$ or $\dot{\varepsilon}$) curves of Al-0.3Fe-0.18Cu alloys with different amounts of Mg. Similarly as FIG. 8, the compressive creep curve consists of the primary creep stage and the second stage. As shown on FIG. 9(A), it can be found that the total creep strain considerably decreases with increasing Mg content and the value decreases from 4.17% in the base alloy (Al-0.3Fe-0.18Cu) to 0.14% in the 0.1% Mg containing alloy (Al-0.3Fe-0.18Cu-0.1Mg). On the other hand, as shown in FIG. 9(B), with increasing Mg from 0% to 0.1%, the $\dot{\varepsilon}_m$ significantly decreases from $7.5\times10^{-8}$ $s^{-1}$ in the base alloy to $4.8\times10^{-10}$ $s^{-1}$ with the 0.1% Mg containing alloy, indicating a strong and positive effect of Mg on improving the minimum creep rate. It is suggested that addition of Mg was beneficial to largely enhance the creep property both at the primary creep stage and second stage.

Figure 10B:
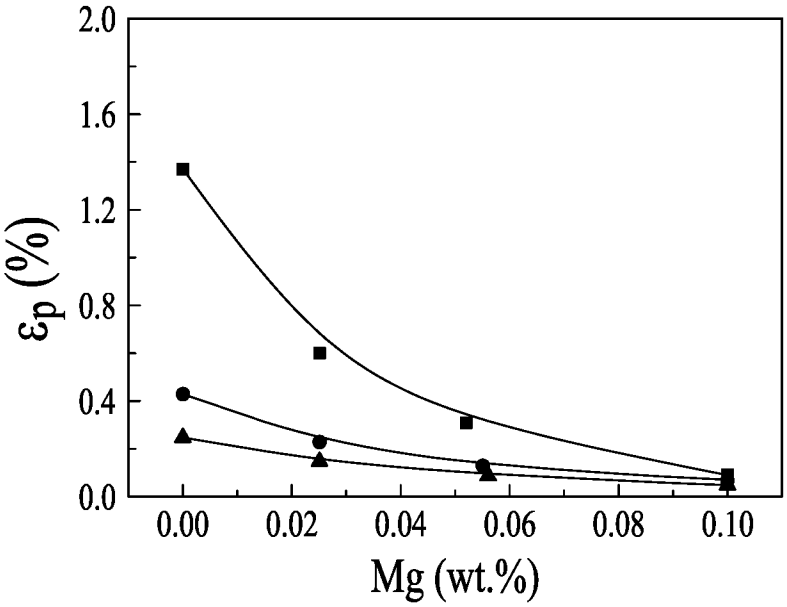
FIGS. 10A to D provide plots illustrating the variation of (A)-(B) the primary creep strain ($\varepsilon_p$ in %) and (C)-(D) minimum creep rate ($\dot{\varepsilon}_m$ in $s^{-1}$) with increasing Cu content ((A) and (C) ■=Al-0.3Fe—Cu; •=Al-0.5Fe—Cu; ▲=Al-0.7Fe—Cu) and increasing Mg content ((B) and (D) ■=Al-0.3Fe-0.18Cu—Mg; •=Al-0.5Fe-0.18Cu—Mg; ▲=Al-0.7Fe-0.18Cu—Mg).
Figure 10A:
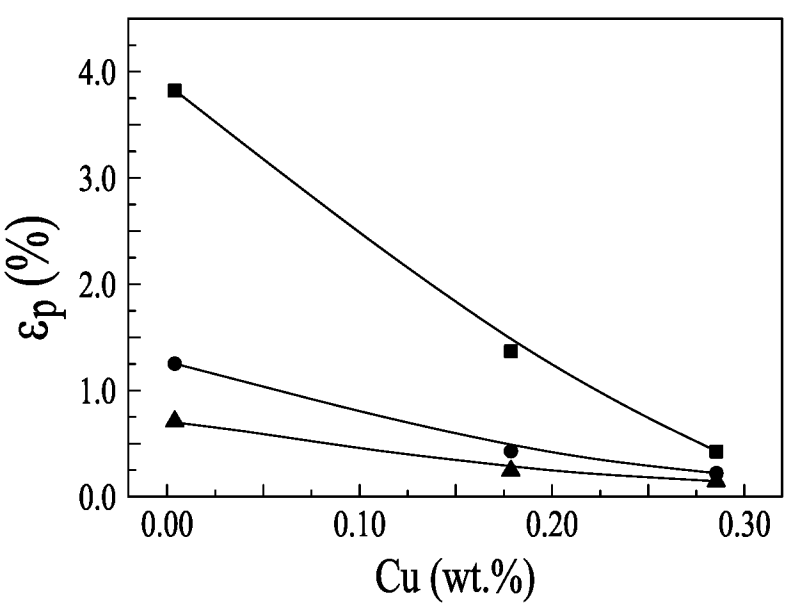
Figure 10D:
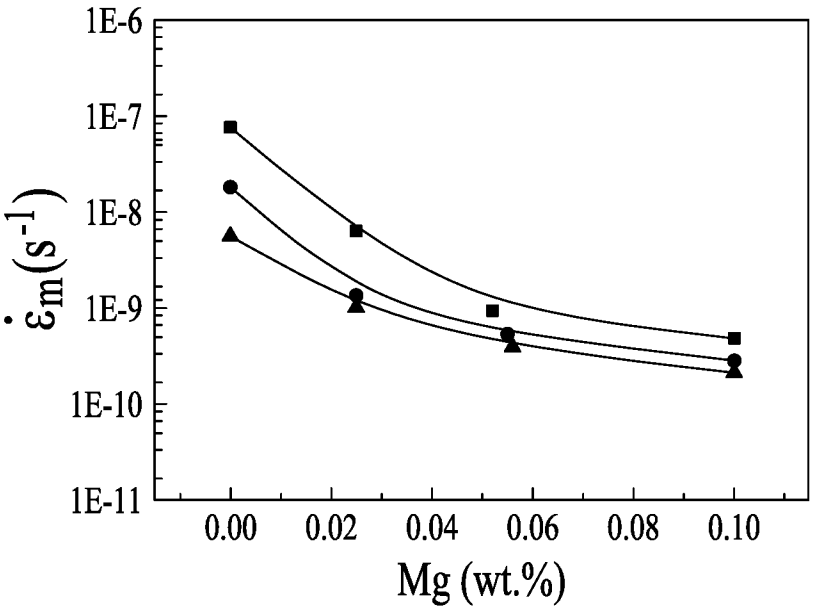

From the creep strain ($\varepsilon$) and creep rate ($d\varepsilon/dt$ or $\dot{\varepsilon}$) curves as shown in FIGS. 8 and 9, it is noted that additions of Cu and Mg showed different impact on the creep resistance of 8xxx aluminum alloys. To better understand the Cu and Mg effect, the evolution of the primary creep strain ($\varepsilon_p$) and minimum creep rate as a function of Cu and Mg contents was evaluated, as shown in FIG. 10. The primary creep strain $\varepsilon_p$ is obtained by extrapolating the second creep curve linearly back to the zero time (X. W. Wei, X. T. Zu, W. L. Zhou, Mater. Sci. Tech. 22 (2006) 730-733), as illustrated by the dotted line in FIG. 8(A). As indicated in FIGS. 10(A) and (B), the primary creep strain $\varepsilon_p$ was significantly decreased with increasing Cu and Mg content. With increasing Cu from 0% to 0.29% in weight percent (FIG. 10(A)), the primary creep strain decreased from 3.82% to 0.43% in Al-0.3Fe—Cu alloys (89% reduction), from 1.25% to 0.22% in Al-0.5Fe—Cu alloys (82% reduction), and from 0.71% to 0.15% in Al-0.7Fe—Cu alloys (79% reduction), respectively. As shown in FIG. 10(B), when Mg increases from 0% to 0.1% (in weight percent), the primary creep strain (sp) greatly decreased from 1.37% to 0.09% in Al-0.3Fe-0.18Cu—Mg alloys (93% reduction), from 0.43% to 0.07% in Al-0.5Fe-0.18Cu—Mg alloys (84% reduction), and from 0.25% to 0.05% in Al-0.7Fe0.18Cu—Mg alloys (80% reduction). The results indicated the positive effect of both minor Cu and Mg additions on primary creep strain.

Figure 10C:
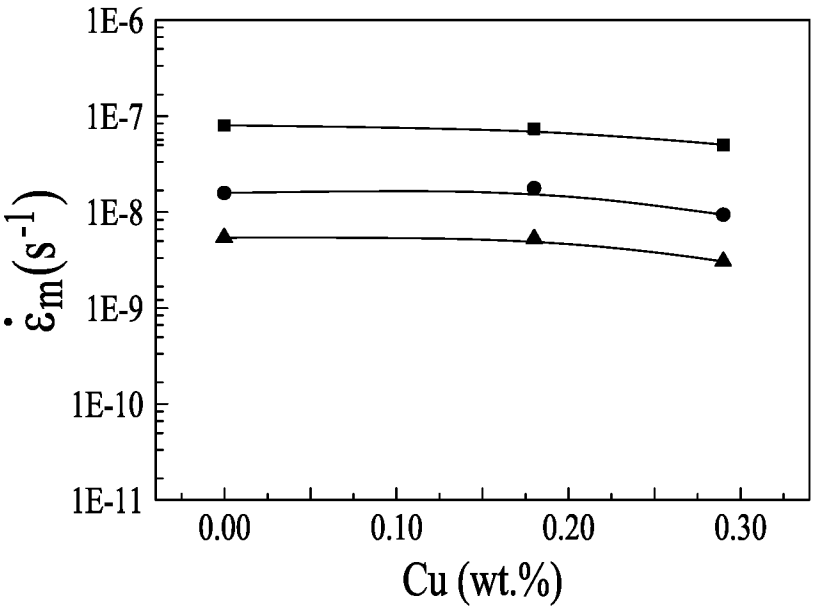

The evolution of minimum creep rate ($\dot{\varepsilon}_m$) as a function of Cu and Mg content is illustrated in FIGS. 10(C) and (D). It is interesting to notice that addition of Cu had almost no effect on the minimum creep rate while Mg remarkably decreased the minimum creep rate. With increasing Mg content from 0% to 0.1% (FIG. 10(*d*)), the minimum creep rate noticeably decreases from $7.5\times10^{-8}$ $s^{-1}$ to $4.8\times10^{-10}$ $s^{-1}$ in Al-0.3Fe0.18Cu—Mg alloys (99% reduction), and from $1.8\times10^{-8}$ $s^{-1}$ to $2.8\times10^{-10}$ $s^{-1}$ in Al-0.3Fe0.18Cu—Mg alloys (98% reduction) and further from $5.6\times10^{-9}$ $s^{-1}$ to $2.1\times10^{-10}$ $s^{-1}$ in Al-0.3Fe0.18Cu—Mg alloys (96% reduction), respectively.

Although additions of minor Cu and Mg can considerably improve the creep properties, individual alloying elements can have different impacts. Firstly, with increasing Cu, the subgrain size slightly decreased, which can moderately retard the dislocation movement and thus decreases the primary creep strain. Moreover, the solid solution strengthening of Cu should be principally responsible for the significant decrease of the primary creep stain, because the Cu solutes increase the work hardening ability of the material. On the other hand, the results show that the minor addition of Cu had no effect on the minimum creep rate during the second creep stage, which is probably due to low interaction between the dislocation and Cu solute atmosphere. Without wishing to be bound to theory, those results suggested that the Cu addition could be effective in increasing creep resistance during the short-term creep deformation, where the primary creep stage plays an important role. Conversely, the Cu addition may not offer an advantage to the creep resistance under the long-term creep deformation.

The minor addition of Mg (0.025-0.1%) in 8xxx aluminum alloy seems not to have obvious effect on the deformed microstructure as shown in FIG. 2. However, it can considerably decrease both the primary creep strain (sp) and minimum creep rate ($\dot{\varepsilon}_m$), resulting in a significant improvement on the creep properties.

It is worthwhile mentioning that the effect of Cu and Mg on the creep property was decreased with increasing Fe in the base alloys, as shown in FIG. 10. Cu and Mg addition are believed to be more effective in increasing the creep property of 8xxx aluminum alloys in low Fe conditions.

In conclusion, the addition of Cu promoted the retardation of the dynamic recovery, which leads to a finer subgrain size. However, the addition of Mg showed little effect on the retardation of the dynamic recovery. The additions of Cu and Mg reasonably increased the UTS but slightly decreased EC. The effects of Cu, Mg and Fe on the UTS and EC were quantitatively evaluated and summarized in Eqs. 3 and 6, which offer a good prediction of the UTS and EC as a function of alloying elements (Cu, Mg and Fe) in 8xxx aluminum conductor alloys. The addition of Cu remarkably decreases the primary creep stain (sp) and shows almost no effect on the minimum creep rate ($\dot{\varepsilon}_m$), leading to a beneficial effect on the early creep deformation but no advantage to the creep resistance under the long-term creep process. The minor addition of Mg greatly reduced both primary creep strain and minimum creep rate, resulting in a significant and effective improvement on the creep resistance of 8xxx aluminum conductor alloys.

Example II—Casting Properties

The materials used in this example were various aluminum alloys as shown in Table 3 (all alloy compositions are in wt. % unless otherwise indicated). The alloys were batched in a 100 tons furnace and cast on a continuous rod casting machine. Liquid metal is solidified in a rectangular bar which is immediately rolled into a 9.5 mm rod.

TABLE 3

Chemical compositions of the experimental alloys investigated (wt. %)

| Alloys | Fe | Cu | Mg | Si | Al |
|---|---|---|---|---|---|
| 1 | 0.69 | 0.18 | — | 0.05 | Balance |
| 2 | 0.55 | 0.01 | — | 0.05 | Balance |
| 3 | 0.35 | 0.17 | — | 0.05 | Balance |
| 4 | 0.16 | — | — | 0.05 | Balance |

Figure 11:
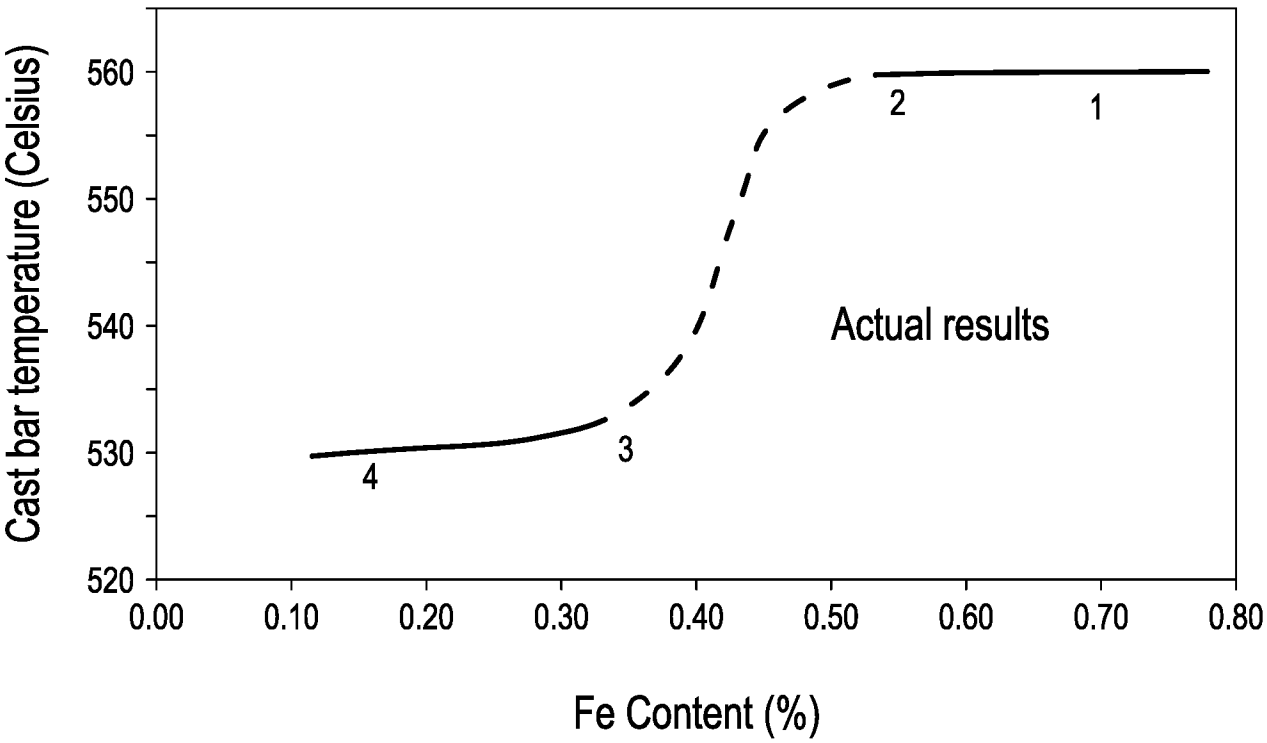
FIG. 11 provides the bar (ingot) temperature (in ° C.) in function of the Fe content of the alloys.

The bar temperature, used as surrogate marker for the casting efficiency, was determined using thermocouple and/or pyrometer. As shown in FIG. 11, aluminum conductor alloys having 0.5 or less Fe exhibit a decreased bar temperature and are thus considered to be casted more efficiently.

While the invention has been described in connection with specific embodiments thereof, it will be understood that the scope of the claims should not be limited by the preferred embodiments set forth in the examples, but should be given the broadest interpretation consistent with the description as a whole.

What is claimed is:

1. An aluminum conductor alloy having increased creep resistance, the aluminum conductor alloy comprising, in weight percent:
up to about 0.10 Si;
up to about 0.5 Fe;
up to about 0.30 Cu;
between about 0.021 and about 0.025 Mg;
up to about 0.04 B; and
the balance being aluminum and unavoidable impurities.

2. The aluminum conductor alloy of claim 1, comprising up to about 0.05 Si, in weight percent.

3. The aluminum conductor alloy of claim 1, comprising between about 0.3 and about 0.5 Fe, in weight percent.

4. The aluminum conductor alloy of claim 1, comprising between about 0.15 and about 0.30 Cu, in weight percent.

5. The aluminum alloy of claim 4, comprising up to about 0.18 Cu, in weight percent.

6. The aluminum alloy of claim 1, comprising between about 0.001 and about 0.04 B, in weight percent.

7. The aluminum alloy of claim 1, having a secondary creep rate of $1\times10^{-8}$ $s^{-1}$ or less when measured at 100° C. under a 69 MPa load.

8. A rod comprising the aluminum conductor alloy of claim 1.

9. An aluminum cast product comprising the aluminum conductor alloy of claim 1.

10. The process of claim 1, wherein the modified aluminum conductor alloy comprises between about 0.15 and about 0.30 Cu, in weight percent.

11. The process of claim 10, wherein the modified aluminum conductor alloy comprises up to about 0.18 Cu, in weight percent.

12. A process for improving the creep resistance of an aluminum product comprising a modified aluminum conductor alloy when compared to a corresponding aluminum product comprising a first aluminum conductor alloy, the process comprising combining Mg with the first aluminum conductor alloy to provide the modified aluminum conductor alloy, wherein the first aluminum conductor alloy comprises, in weight percent:
up to about 0.10 Si;
up to about 0.5 Fe;
up to about 0.30 Cu;
up to about 0.04 B; and
the balance being aluminum and unavoidable impurities;
wherein the modified aluminum alloy comprises between about 0.021 and about 0.025 Mg.

13. The process of claim 12, wherein the modified aluminum conductor alloy comprises up to about 0.05 Si, in weight percent.

14. The process of claim 12, wherein the modified aluminum conductor alloy comprises between about 0.3 and about 0.5 Fe, in weight percent.

15. The process of claim 12, wherein the modified aluminum conductor alloy comprises between about 0.001 and about 0.04 B, in weight percent.

16. The process of claim 12, wherein the modified aluminum conductor alloy has a secondary creep rate of $1\times10^{-8}$ $s^{-1}$ or less when measured at 100° C. under a 69 MPa load.

17. An aluminum conductor alloy having increased creep resistance, the aluminum conductor alloy consisting essentially of, in weight percent:
up to about 0.10 Si;
up to about 0.5 Fe;
up to about 0.30 Cu;
between about 0.021 and about 0.025 Mg;
up to about 0.04 B; and
the balance being aluminum and unavoidable impurities.

18. The aluminum conductor alloy of claim 17, wherein the aluminum conductor alloy contains between about 0.001 and about 0.04 B, in weight percent.

* * * * *